US006300300B1

(12) United States Patent
Sanchez

(10) Patent No.: US 6,300,300 B1
(45) Date of Patent: Oct. 9, 2001

(54) LIQUID CLEANING, DEGREASING, AND DISINFECTING CONCENTRATE AND METHODS OF USE

(75) Inventor: Michael J. Sanchez, Eaton Rapids, MI (US)

(73) Assignee: MWJ, L.L.C., Holt, MI (US)

( * ) Notice: Subject to any disclaimer, the term of this patent is extended or adjusted under 35 U.S.C. 154(b) by 0 days.

(21) Appl. No.: 09/799,612

(22) Filed: Mar. 9, 2001

(51) Int. Cl.[7] ..... C11D 3/22; C11D 7/06; C11D 3/36

(52) U.S. Cl. ..... 510/365; 510/191; 510/235; 510/238; 510/245; 510/252; 510/272; 510/362; 510/435; 510/467; 510/470

(58) Field of Search ..... 510/191, 235, 510/238, 245, 252, 272, 362, 365, 435, 467, 470

(56) References Cited

U.S. PATENT DOCUMENTS

| | | | | |
|---|---|---|---|---|
| 4,606,850 | * | 8/1986 | Malik | 252/528 |
| 5,308,531 | * | 5/1994 | Urfer et al. | 252/174.17 |
| 5,575,864 | * | 11/1996 | Haley et al. | 134/42 |
| 5,591,376 | * | 1/1997 | Kiewert et al. | 510/437 |

* cited by examiner

*Primary Examiner*—Yogendra N. Gupta
*Assistant Examiner*—Charles Boyer
(74) *Attorney, Agent, or Firm*—Knechtel, Demeur & Samlan

(57) ABSTRACT

The present invention relates to cleaning and degreasing compositions. It is an aqueous concentrate comprising caustic soda, a metal salt of silica, three surfactants, and a bonding agent. The concentrate can be diluted to provide a reusable, low foaming, non-toxic and biodegradable composition useful for degreasing, cleaning, and disinfecting, and for separating solids, oils, and greases suspended in water. Methods of use are also provided.

8 Claims, No Drawings

LIQUID CLEANING, DEGREASING, AND DISINFECTING CONCENTRATE AND METHODS OF USE

I. TECHNICAL FIELD

This invention relates to liquid cleaning concentrates and more particularly to novel concentrate compositions, and their methods of use, suitable for formulating reusable, low foaming, non-flammable, non-toxic, and biodegradable solutions for use in cleaning, degreasing, and disinfecting soiled areas and separating water from solids, oils, and greases suspended in the water.

II. BACKGROUND OF THE INVENTION AND PRIOR ART

Cleaning concentrates that remove grease from surfaces and disperse oil spills are well known. The prior art is replete with such concentrates. Much of the prior art is directed to general cleaning compositions. Of these, some prior art patents are directed to concentrates suitable for use as degreasing agents. For example, U.S. Pat. No. 4,704,225 teaches a composition for removing wax, grease, oils, and fats. This composition employs a terpene hydrocarbon, a fatty acid and water. Another example is seen in U.S. Pat. No. 5,527,486 which teaches a composition for removing tar and grease without any mechanical activity (i.e. scrubbing). This composition employs a polar solvent, a water soluble or dispersible amphiphile, and a non-polar solvent in combination. Yet another example is seen in U.S. Pat. No. 5,549,840 which teaches a composition for use in the removal of oily and greasy soil. This composition employs surfactants in combination with an ethoxylated glycerol. Further examples are seen in U.S. Pat. No. 5,585,034; 5,527,486; 5,643,861; and 5,602,090.

While the prior art can be useful, they are not without shortcomings. For example, many formulations are toxic to the environment. As a result, the manner in which the concentrate can be used or disposed of after use is limited. A related shortcoming is that many compositions contain phosphates which can upset the ecosystems by causing planktonic blooms which can result in ecosystem imbalances.

Another shortcoming is that because the formulation is discharged along with the greases, it may be used for only a single application, thus, increasing costs associated with cleanup.

Yet another disadvantage is that some prior art compositions are high foaming which creates pumping and disposal problems. Still another shortcoming of prior art compositions is that many are not biodegradable which means that the compositions may remain harmful long after being introduced into the environment.

Still another disadvantage of prior art compositions is that when used to "clean up" oil spills they often do not provide any means to facilitate oil collection. These compositions merely cause the oil to emulsify with the water rather than force separation which would facilitate cleanup. The emulsified oil is then spread by the action of wind, waves, and tides, which merely makes the water appear to be cleaner.

Another problem associated with conventional cleaning compositions is that they leave a residue which must be removed by, for example, immersing the object in an acid bath or by using organic solvents such as mineral spirits, naphtha, or xylene. All these materials and methods pose potential health hazards and result in additional costs in labor, materials, precautions, and proper disposal.

III. OBJECTS OF THE INVENTION

It is an object of the present invention to provide a liquid cleaning, degreasing, and disinfecting concentrate to separate water, oils, and greases from solids and each other.

It is an object of this invention to provide a cleaning concentrate and degreaser that is non-toxic.

It is another object of this invention to provide a cleaning concentrate and degreaser that is low foaming, It is another object of this invention to provide a cleaning concentrate and degreaser that is reusable.

It is yet another object of this invention to provide a cleaning concentrate and degreaser which is biodegradable within 30–45 days after activation by contact with fresh or salt water.

It is yet another object of this invention to provide a cleaning concentrate and degreaser which has de-emulsifier properties.

It is still another object of this invention to provide a composition that removes corrosion, rust and scale from metal and leaves a paintable protective microfilm layer to reduce scale build up on metal surfaces.

It is still another object of this invention to provide a cleaning concentrate and degreaser that is not carcinogenic.

It is still another object of this invention to provide a cleaning concentrate and degreaser that is not flammable.

It is still another object of this invention to provide a composition that reliquifies waxy paraffins.

It is still another object of this invention to provide a composition that separates solids and water from crude oil.

It is another object of this invention to provide a composition that has disinfecting properties.

Other objects of the present invention will become more apparent to persons having ordinary skill in the art to which the present invention pertains from the following description.

IV. SUMMARY OF THE INVENTION

The above objects of the Invention are provided for in a chemical composition in concentrate form suitable for use as a cleaning, degreasing, and disinfecting agent. According to the invention, a chemical composition comprising, in combination, caustic soda, a de-emulsifying agent, an alkyl glucoside surfactant, a phosphated alkyl ethoxylate surfactant, a tridecyl alcohol surfactant, and a bonding agent is provided in concentrate form. Water is added to the concentrate in varying amounts that are dependent on the intended use for the resulting solution. The solution at varying strengths is useful for a wide range of situations including, but not limited to, degreasing equipment to separating oil and water. The solution also provides some disinfecting properties.

V. DESCRIPTION OF THE INVENTION

The invention is a chemical composition in concentrate form suitable for use as a cleaning, degreasing, and disinfecting agent. The composition provides unique characteristics and properties that include but are not limited to being non-toxic and safe for the environment, low foaming, reusable, biodegradable, non-carcinogenic, disinfectant, and non-flammable. These characteristics and properties are discussed in further detail in the illustrative examples provided below.

The components of the invention comprise caustic soda, a de-emulsifier, an alkyl glucoside surfactant, a phosphated alkyl ethoxylate, tridecyl alcohol, a bonding agent, and water.

The caustic soda, e.g., sodium hydroxide, serves to maintain alkalinity in acidic situations and enhance cleaning properties of the composition. In the preferred embodiment, liquid caustic soda is utilized. The inventor has found that liquid caustic soda Product Number "11–58 Diaphragm Grade," available from OxyChem Occidental Chemical Corp., is a superior caustic soda. Alternatively, an acceptable substitute for the caustic soda component is: (1) potassium hydroxide also known as caustic pot ash, and (2) potassium carbonate.

A de-emulsifier is used to facilitate the separation of water and oil from a water and oil emulsion. In the preferred embodiment, a metal salt of silica is used. The inventor has found that "Sodium Silicate-Liquid Grade 52," available from OxyChem Occidental Chemical Corp., makes an excellent de-emulsifier. Alternatively, an acceptable substitute for the de-emulsifier component is sodium pentahydrate.

A low foaming, alkyl glucoside surfactant is added which acts as a heavy detergent and leaves a protective film on the surface to be treated. The inventor has found that "Triton B6-10," available from Union Carbide Chemicals & Plastics Co. Inc. (now a Dow Company) provides good results. Alternatively, an acceptable substitute for the alkyl glucoside surfactant component is the combination of either the Triton X-301 surfactant mixed with the Triton H-55 surfactant or the Triton X-301 surfactant mixed with the Trition H-66 surfactant. Triton® is a registered trademark and the Triton surfactants are both owned by Union Carbide.

A low foaming phosphated alkyl ethoxylate heavy detergent surfactant is added to enhance cleaning properties. Preferably, "Tryfac 5554," available from Cognis Corporation, is a suitable surfactant for use and provides good results.

A tridecyl alcohol surfactant is added to enhance the cleaning properties and to help render the surfactants non-ionic. Preferably, "Trycol 5949 (TDA-8)," available from Cognis Corp., likewise, is a suitable surfactant for use and provides good results.

A low foam, non-polar, bonding agent is also added. Depending upon the specific applications, as discussed below, preferred bonding agents are: (1) "sodium xylene sulfonate, 40%," available from Van Waters & Rogers, Inc., and (2) "Bio-Terg," available from Stepan Inc. Alternatively, an acceptable substitute for the non-polar bonding agent is Alpha-Step MC-48.

As discussed below, water is added in an amount sufficient to give the composition the desired consistency and pourability. In the preferred embodiment, the addition of water is in an amount insufficient to activate the compositions.

It will be appreciated by those skilled in the art that the Compositions may be prepared in a wide range of batch sizes. Preferably, a batch size of 250 gallons has been shown to provide several production advantages. The examples which follow are based on batch sizes of 250 gallons. Alternatively, batch sizes of 275 gallons are also acceptable.

The compositions can be prepared by any customary industry means. The Inventor supplies the following mixing procedure as an example only. About 100 gallons of cold water (about 40% by volume of the composition) is introduced into a stainless steel vessel. Additional water will be introduced during the remaining mixing steps in a controlled amount so that at the conclusion of the final mixing step the total volume of the composition will be about 250 gallons. Depending on the specific composition, this ranges from about 80.5 gallons to about 106.5 gallons (about 32% to about 42.6% by volume).

The alkyl glucoside surfactant is then introduced into the stainless steel vessel. After waiting for a period of time sufficient for uniform mixing (usually about 10 minutes), the caustic soda is introduced and allowed to thoroughly mix with the contents of the vessel. The tridecyl surfactant and the phosphated alkyl ethoxylate surfactants are then introduced into the vessel and allowed to mix with the contents of the vessel. These components may be introduced in any order or may be introduced together. The non-polar bonding agent is then introduced and allowed to thoroughly mix with the contents of the vessel. The de-emulsifier is then introduced and is thoroughly mixed with the contents of the vessel.

The vessel is also provided with a recirculating means disposed at the bottom of the vessel. During the mixing process, the mixture is drawn from the bottom of the stainless steel vessel, filtered and re-introduced into the vessel. This step helps assure quality control and provides the additional advantage of improving the mixing and homogenizing of the composition.

Additional water is then introduced in a controlled amount during the mixing process (commencing with the addition of the caustic soda and ending with the mixing of the de-emulsifier) so that final volume of the volume of the mixture is about 250 gallons. Water should be introduced during the mixing process only. If water is introduced after the final mixing step, the composition will activate and begin to biodegrade until it becomes inert within about 30–45 days. The inactivated composition has a shelf life of at least three years or 36 months and may be activated by contact with either fresh or salt water.

In addition to the characteristics and properties provided by the composition, the composition is effective for use in a variety of situations to clean, degrease, and disinfect. This includes but is not limited to oil, grease, rust, and corrosion removal, reliquifying paraffins.

In the preferred embodiment, the chemical composition is effective as a cleaning, degreasing, and disinfecting agent with the components of the chemical composition, in either liquid or power form, consisting of the following ranges by volume: caustic soda is between 0.181% to 5.45%, the de-emulsifier is between 0.028% and 9.09%, the alkyl glucoside surfactant is between 0.090% to 7.27%, the phosphated alkyl ethoxylate surfactant is between 0.028% and 1.81%, the tridecyl alcohol surfactant is between 0.363% and 9.09%, the non-polar bonding agent is between 0.028% and 1.81%, with the remaining percentage consisting of water that may be of any temperature above freezing.

The following examples illustrate the representative mixtures, dilutions, and for these uses of the composition. These examples are non-limiting and are for instruction purposes only. As those skilled in the arts will quickly understand, there are many variations of the invention, all of which are contemplated by the inventor, that put the invention to practical use.

EXAMPLE 1

A liquid cleaning and degreasing concentrate having the following formula was prepared:

| Component | Amount (Gals.) | Percent by Vol. |
|---|---|---|
| Caustic soda | 1.00 | 0.4 |
| De-emulsifier | 25.00 | 10.0 |
| Alkyl glucoside surfactant | 5.00 | 2.0 |
| Phosphated alkyl ethoxylate surfactant | 1.50 | 0.6 |
| Tridecyl alcohol surfactant | 10.00 | 4.0 |
| Non-polar bonding agent | 1.00 | 0.4 |
| Water | 206.50 | 82.6 |
| Totals: | 250.00 | 100.0 |

Example 1 is a cleaning and degreasing composition especially suitable for the unique needs of the maritime industry, e.g., to clean engine room walls, machinery, bilge water, or oil/water separators. The composition is effective for 30–45 days, after which, the composition begins to biodegrade. As the composition bonds with the water, it causes the paraffin, e.g. oil and grease, to be released or separated from the water and placed back into its individual liquid state. This bonding of the composition with the water also prevents the paraffin from re-bonding or re-mixing to the water. Due to the density of the oil with respect to water, upon the separation from the water, the oil or grease will float to the top surface of the water. Thus, the paraffin or oil effluent can be easily collected for proper disposal or, alternatively, collected and recycled for further use. The composition will also enable the separation of the oil and grease from a solid product or object and prevent the oil or grease from re-bonding to the product such a rag material or pipe. Alternatively, for other types of solid products or objects, the oil or grease may be oxidated from the solid product by a cloth rag or other type of wiping material. In this manner, the composition enables the oil and grease to be removed from the solid product or object by the wiping material and then further separated from the wiping material into its individual form for further use. The solid product or object and wiping material are subsequently cleaned of the paraffin and remain available for further use.

With respect to the composition, as the oil and grease is expunged from the water for collection or other means, the mire of water and composition are purified of the oil or grease. In the preferred embodiment, the composition may be saved and continually reused to remove oil and grease from other water or solid products. Alternatively, as the components of the composition are environmentally friendly and biodegradable, the water and composition mixture can be pumped overboard and/or discarded without harm to the environment.

EXAMPLE 2

An industrial grade liquid cleaning and degreasing concentrate having the following formula was prepared:

| Component | Amount (gals) | Percent vol. |
|---|---|---|
| Caustic soda | 20.00 | 8.0 |
| De-emulsifier | 25.00 | 10.0 |

-continued

| Component | Amount (gals) | Percent vol. |
|---|---|---|
| Alkyl glucoside surfactant | 5.00 | 2.0 |
| Phosphated alkyl ethoxylate surfactant | 1.50 | 0.6 |
| Tridecyl alcohol surfactant | 10.00 | 4.0 |
| Non-polar bonding agent | 62.50 | 0.4 |
| Water | 126.00 | 75.0 |
| Totals: | 250.00 | 100.0 |

Example 2 is a formulation designed to remove oil, grease, and rust and corrosion from a wide range of surfaces and materials in industrial settings, e.g., assembly plants. Upon application to the surfaces and materials, the composition begins to separate the oil, grease, or rust from the surfaces and materials and, thereby, enables the oxidation to be wiped away to effectively clean the surface or material of any residue from the oil, grease, or rust.

With respect to automobiles or any other type of machine that accumulates such oil, grease, or rust problems, the application of this composition removes the rust and corrosion to enable the body of the automobile to be effectively painted absent the need for sanders and other equipment. With respect to sleepers for semi-tractor traitors and other type of machines or buildings that have such surfaces, the application of this composition enables proper cleansing of the surface for gluing or attachment to fiberglass.

EXAMPLE 3

A liquid cleaning and degreasing concentrate especially suitable for use in the petroleum industry having the following formula was prepared:

| Component | Amount (gals) | Percent (vol) |
|---|---|---|
| Caustic soda | 1.00 | 0.4 |
| De-emulsifier | 25.00 | 10.0 |
| Alkyl glucoside surfactant | 5.00 | 2.0 |
| Phosphated alkyl ethoxylate surfactant | 1.50 | 0.6 |
| Tridecyl alcohol surfactant | 15.00 | 6.0 |
| Non-polar bonding agent | 1.00 | 0.4 |
| Water | 201.50 | 80.6 |
| Total: | 250.00 | 100.0 |

Example 3 is a formulation particularly suitable for application in the petroleum industry, e.g., oil wall rejuvenation, settlement pit recovery, and pipeline cleaning.

EXAMPLE 4

A liquid cleaning, degreasing, and disinfecting concentrate having the following formula was prepared:

| Component | Amount (Gals) | Percent by Vol |
|---|---|---|
| Caustic soda | 2.00 | 0.8 |
| De-emulsifier | 25.00 | 10.0 |
| Alkyl glucoside surfactant | 5.00 | 2.0 |
| Phosphated alkyl ethoxylate surfactant | 1.50 | 0.6 |
| Tridecyl alcohol surfactant | 15.00 | 6.0 |

-continued

| Component | Amount (Gals) | Percent by Vol |
|---|---|---|
| Non-polar bonding agent | 1.00 | 0.4 |
| Water | 200.50 | 80.2 |
| Total: | 250.00 | 100.0 |

Example 4 is a formulation while in addition to its cleaning and degreasing properties is also a disinfectant. It may be used, e.g., for window cleaning, washing walls and ceilings, stripping wax and carpet cleaning. It has disinfectant properties effective against many bacteria and viruses.

EXAMPLE 5

A liquid cleaning, degreasing, and disinfecting concentrate having the following formula was prepared:

| Component | Amount (Gals) | Percent by Volume |
|---|---|---|
| Caustic soda | 2.00 | 0.8 |
| De-emulsifier | 45.00 | 18.0 |
| Alkyl glucoside surfactant | 5.00 | 2.0 |
| Phosphated alkyl ethoxylate surfactant | 1.50 | 0.6 |
| Tridecyl alcohol surfactant | 15.00 | 6.0 |
| Non-polar bonding agent | 1.00 | 0.4 |
| Water | 180.50 | 72.2 |
| Total: | 250.00 | 100.0 |

This formula is ideal for cleaning, degreasing, and disinfecting medical and dental equipment in a cold sterilization environment.

While the invention has been described in conjunction with a specific embodiment and at least five examples for illustration purposes, it is evident that many alternatives, modifications and variations will be apparent to those skilled in the art in light of the foregoing description. Accordingly, it in intended to embrace all such alternatives, modifications and variations as fall within the spirit and scope of the appended claims.

What is claimed is:

1. A liquid cleaning, degreasing, and disinfecting concentrate composition, comprising:

(a) caustic soda;

(b) a de-emulsifier;

(c) an alkyl glucoside surfactant;

(d) a phosphated alkyl ethoxylate surfactant;

(e) a tridecyl alcohol surfactant;

(f) a non-polar bonding agent; and (g) water.

2. A liquid cleaning, degreasing, and disinfecting concentrate composition, comprising:

(a) caustic soda in a range of about 0.181% to about 5.45% by volume;

(b) a de-emulsifier in a range of about 0.028% to about 9.09% by volume;

(c) an alkyl glucoside surfactant of about 0.090% to about 7.27% by volume;

(d) a phosphated alkyl ethoxylate surfactant of about 0.028% to about 1.81% by volume;

(e) a tridecyl alcohol surfactant in a range of about 0.363% to about 9.09% by volume;

(f) a non-polar bonding agent of about 0.028% to about 1.81% by volume; and, (g) water forming the remainder percentage by volume.

3. A method of making a liquid cleaning and degreasing concentrate composition, comprising the steps of:

(a) introducing water into a mixing vessel;

(b) introducing an alkyl glucoside surfactant into the vessel and mixing with the water;

(c) introducing caustic soda into the vessel and mixing with the contents of the vessel;

(d) introducing a tridecyl alcohol and a phosphated alkyl ethoxylate surfactant into the vessel in either order and mixing with the contents of the vessel; and (e) introducing a non-polar bonding agent into the vessel and mixing with the contents of the vessel.

4. The method of claim 3 including the further step of adding additional water to the mixture during the mixing process in an amount sufficient to create the desired formula concentration.

5. The method of claim 3 including the further step of activating the concentrate by adding water to the concentrate after the mixing process is complete.

6. A method of making a liquid cleaning and degreasing concentrate composition, comprising the steps of:

(a) introducing water into a mixing vessel;

(b) introducing an alkyl glucoside surfactant into the vessel and mixing with the water;

(c) introducing caustic soda into the vessel and mixing with the contents of the vessel;

(d) introducing a tridecyl alcohol and a phosphated alkyl ethoxylate surfactant into the vessel in simultaneously and mixing with the contents of the vessel; and (e) introducing a non-polar bonding agent into the vessel and mixing with the contents of the vessel.

7. The method of claim 6 including the further step of adding additional water to the mixture during the mixing process in an amount sufficient to create the desired formula concentration.

8. The method of claim 6 including the further step of activating the concentrate by adding water to the concentrate after the mixing process is complete.

* * * * *